US007674055B2

(12) United States Patent
Hiroike et al.

(10) Patent No.: US 7,674,055 B2
(45) Date of Patent: Mar. 9, 2010

(54) LABEL PRINTER WITH A LABEL PEELING MECHANISM AND A CONTROL METHOD FOR THE SAME

(75) Inventors: Go Hiroike, Matsumoto (JP); Toshihiro Tsukada, Shiojiri (JP); Toru Takami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1200 days.

(21) Appl. No.: 11/181,283

(22) Filed: Jul. 14, 2005

(65) Prior Publication Data

US 2006/0162842 A1 Jul. 27, 2006

(30) Foreign Application Priority Data

Jul. 23, 2004 (JP) ..... 2004-216545
Sep. 8, 2004 (JP) ..... 2004-261201

(51) Int. Cl.
*B41J 15/00* (2006.01)
*B41J 11/42* (2006.01)

(52) U.S. Cl. ..... 400/614; 400/586; 400/615.2; 400/74; 400/76

(58) Field of Classification Search ..... 400/602, 400/595–596, 607, 607.2, 614–615.2, 586, 400/74, 691; 235/2–5, 7 R; 156/361, 378, 156/384

See application file for complete search history.

(56) References Cited

U.S. PATENT DOCUMENTS 5,164,570 A * 11/1992 Okimura ..... 219/216
5,218,353 A * 6/1993 Okumura et al. ..... 340/815.65
5,964,539 A 10/1999 Yamaguchi et al. .... 400/120.16
5,980,138 A 11/1999 Shiozaki et al. ..... 400/582
6,068,419 A 5/2000 Shiozaki et al. ..... 400/582
6,092,945 A 7/2000 Takami et al.
6,132,120 A 10/2000 Yamaguchi et al. ..... 400/615.2
6,190,069 B1 2/2001 Yamaguchi et al. ..... 400/615.2
6,196,740 B1 3/2001 Yamaguchi et al. ..... 400/615.2
6,334,724 B2 1/2002 Yamaguchi et al. ..... 400/615.2
6,491,459 B2 12/2002 Hosomi
6,505,981 B1 1/2003 Takami et al. ..... 400/602
6,709,179 B2 3/2004 Yamaguchi et al. ..... 400/693.1
7,121,313 B2 10/2006 Ito

FOREIGN PATENT DOCUMENTS

JP 58211476 * 12/1983
JP 08-217040 8/1996
JP 8-267848 10/1996
JP 8-295323 11/1996
JP 08-300752 11/1996
JP 08-337579 * 6/1998

(Continued)

*Primary Examiner*—Judy Nguyen
*Assistant Examiner*—Marissa L Ferguson-Samreth

(57) ABSTRACT

A label printing apparatus having a label peeling mechanism determines the appropriate time to run a process for setting the paper. Paper having a plurality of labels continuously affixed to a web liner is loaded inside the label printing apparatus when a main cover is open. A peeling mechanism cover is attached and openable from the main cover. When opened, the paper is routed through one path or another to exit the printer from one or another exit depending on whether or not the peeling mechanism is used. A control method for this printer has a step of waiting for a switch to be pressed by an operator after the operator puts the paper inside the label printer and closes the main cover, and a step of executing a paper setup process when the switch is pressed.

8 Claims, 12 Drawing Sheets

FOREIGN PATENT DOCUMENTS

| | | |
|---|---|---|
| JP | 10-166629 | 6/1998 |
| JP | 10-193651 | 7/1998 |
| JP | 11171155 | 6/1999 |
| JP | 11-277821 | 10/1999 |
| JP | 11-314624 | 11/1999 |
| JP | 2001-232875 | 8/2001 |
| JP | 2002019218 | 1/2002 |
| JP | 2004-115041 | 4/2004 |

* cited by examiner

LABEL PRINTER WITH A LABEL PEELING MECHANISM AND A CONTROL METHOD FOR THE SAME

BACKGROUND OF THE INVENTION

1. Field of the Invention

The present invention relates generally to a label printer for printing labels affixed to a web liner, and relates more particularly to a label printer having a label peeling mechanism for peeling labels from a web liner, and to a control method for this label printer.

2. Description of the Related Art

Label printers are used for printing labels with such information as a product name, price, and product code (barcode). The labels are thereafter affixed to products.

In the back room of a store, for example, the label printer is typically placed on a work-table to print labels, and as the labels are affixed to the products as they are printed and peeled from a web liner. Label printers are also used to batch print multiple labels, which are then taken to a separate location, such as the warehouse where the products are stored, and the labels are applied to the individual products.

In the former application, a label peeling mechanism is preferably used to automatically peel the labels one by one from the web liner as the labels are printed.

A label printer with such a label peeling mechanism is taught in Japanese Unexamined Patent Appl. Pub. H8-295323 (corresponding to U.S. Pat. No. 5,980,138), for example. This label printer stores a roll of label paper having labels affixed at a constant interval to the surface of a continuous web liner in a storage compartment inside the printer. The leading end of the roll paper is fed between the print head and platen roller so that the roll paper can be advanced and printed, and is then passed outside of the printer. The web liner (or simply web) held between and conveyed by the drive platen roller and a peeling roller (pinch roller) that rotates following the platen roller.

This printer can be set to operate in a non-peeling mode (continuous printing mode) in which the label peeling mechanism is not used or a peeling mode in which the label peeling mechanism is used. The non-peeling mode is set by passing the leading end of the roll paper (labels affixed to a web liner) through the label discharge opening (label dispenser opening) of the label peeling mechanism, and enables printing and outputting multiple labels intact on the web. The peeling mode is set by threading the leading end of the roll paper around a curved portion of the label peeling mechanism before passing the end outside the printer, thus enabling the label peeling mechanism to peel and dispense the printed labels one by one from the web as the labels are printed.

Whether the label peeling mechanism is used or not is selected by the operator opening the peeler cover, which is part of the peeling mechanism, and passing or not passing the leading end of the roll paper out through the label discharge opening (label dispenser opening).

To set the label paper 58 (roll paper having labels affixed at a constant interval to a web liner 59) to use the peeling mode as shown in FIG. 12A, a number of labels must first be peeled from the leading end of the label paper 58 so that only the web liner 59 is left. When the label peeling mechanism is used, the web liner 59 is held and conveyed between the platen roller 50 and peeling roller 50*a* after the labels are peeled. This is because the paper transportation load is high around the web-bending guide 53 of the label peeling mechanism, and if thick paper, such as label paper 58 having the labels intact on the web liner 59, is fed between the platen roller 50 and peeling roller 50*a*, the transportation load is even greater and feeding the label paper may not be possible. In addition, the labels tend to separate from the web and stick to the platen roller 50 or peeling roller 50*a*, and paper jams thus occur easily. As a result, a number of labels must be removed from the leading end of the label paper 58 and only the web liner 59 is fed between the platen roller 50 and peeling roller 50*a*.

The label peeling mechanism also has a web-bending guide 53 positioned in the transportation path whereby the label paper 58 is conveyed between the platen roller 50 and thermal print head 51 in conjunction with clockwise rotation of the platen roller 50. The web-bending guide 53 of the label peeling mechanism causes the label paper 58 to curve through an acute angle to the back (non-label) side of the web. When the label paper 58 passes over the web-bending guide 53 of this label peeling mechanism, the first label 60*a* adhesively affixed to the front surface of the web liner 59 is unable to follow the transportation path of the web liner 59 and is thus disengaged from the web liner 59. The peeled label 60*a* is then discharged externally to the printer from the label discharge slot 55. The remaining web liner 59 follows a different transportation path, and the label 60*a* and web liner 59 are thus separated. This is shown in FIG. 12A.

When this label peeling mechanism is used to peel labels 60*a* from the web liner 59 and dispense the labels 60*a* from the label discharge slot 55, the labels 60*a* are gradually peeled from the leading end thereof in the paper transportation direction by routing the web liner 59 to which the labels 60*a* are affixed around the web-bending guide 53, and transporting the web liner 59 pauses at a position where a slight portion of the trailing end of the label 60*a* remains attached to the web liner 59. This is because the label 60*a* will fall out from the label discharge slot 55 if the label 60*a* is completely separated from the web liner 59. A peeled label detection sensor 56 can detect the peeled label 60*a* is in the label discharge slot 55.

When the label paper 58 passes a label detection sensor 57, the label detection sensor 57 detects the trailing end of the first label 60*a* and the leading end of the next label 60*b*, and the positions of the labels 60*a*, 60*b* can thus be known. The label 60*a* can thus be stopped at the appropriate position. This operation results in the first label 60*a* being discharged without being printed.

As shown in FIG. 12B, the label printer then waits for the discharged label 60*a* to be removed from the web liner 59. The peeled label detection sensor 56 detects when the operator manually removes the label 60*a*, thus triggering the platen roller 50 to rotate counterclockwise as shown in FIG. 12C to reverse the label paper 58 and position the leading end of the next label 60*b* on the web liner 59 relative to the thermal print head 51 for printing. Note that the position shown in FIG. 12C is called the "label indexing position."

The label paper 58 is reversed because advancing the label paper 58 to where the operator can remove the discharged label (to the position shown in FIG. 12A, referred to as the "label peeling position") positions the leading end of the next label 60*b* beyond (that is, downstream of) the printing position of the thermal print head 51. If printing then proceeds from this position, the next label 60*b* will be printed from some middle part of the label. By reversing the label paper 58, however, printing can start from the leading end of the next label 60*b* ("label indexing position") when the print data is received.

Whether using the label printer in the peeling mode or using the label printer in the non-peeling mode, the label printer must be mechanically reinitialized (reset) when a new roll is loaded after the last label on a roll is printed and the roll has ended. This involves positioning the leading end of the first label on the new roll next to the printing position of the print head (label indexing process) so that printing can start from the leading end of the label ("label indexing position").

More particularly, the paper transportation mechanism is driven by a motor to advance the roll paper relative to the print head in this label indexing process. Because the label printer described above is a thermal printer, the roll paper is held between the print head and platen roller, and the platen roller is driven rotationally to convey the roll paper. The platen roller is positioned on the main cover side of the printer, and the print head is positioned inside the printer case.

To replace the roll paper the main cover is opened, the platen roller is released from the print head, and the roll paper is passed between the platen roller and print head. When the main cover is then closed, the roll paper is held between the platen roller and print head, and the roll paper can be transported. The label indexing process must therefore be executed after confirming that the main cover of the label printer is closed.

However, the label printer cannot automatically execute the label indexing process and start printing as soon as print data is received just because the main cover is detected to be in the closed position. This is because in a label printer with an on-board label peeling mechanism the peeling mechanism must be opened after closing the main cover, the roll paper must be loaded into the transportation path used for the peeling mode or the non-peeling mode as desired and the peeling mechanism is then closed to set the roll paper in the desired transportation path. Furthermore, because the operator loads the roll paper, the operator could close the peeling mechanism with the paper accidentally loaded into the wrong transportation path. If the mechanical reset process and printing start with the roll paper loaded into the wrong transportation path, labels are wasted and paper jams or other problems can occur.

A problem with a label printer having a label peeling mechanism as described above is that whether or not the label paper is loaded into the correct transportation path of the peeling mechanism must be confirmed, and the printer cannot be immediately and automatically mechanically reset just because the main cover and peeling mechanism cover are closed.

The label paper 58 used in a printer having a label peeling mechanism has many labels 60*a*, 60*b* adhesively affixed to the surface of a continuous web liner 59. When new label paper 58 is loaded into the label peeling mechanism of the printer, a number of labels must be manually removed from the leading end of the label paper 58 so that only the bare web liner 59 is passed around the web-bending guide 53. This is bothersome for the operator and wastes many labels.

Furthermore, if the leading portion of a label affixed to the web liner 59 is positioned to the distal curved portion of the web-bending guide 53 when the label paper is loaded, the leading end of that label disengages from the web liner 59 and exposes the adhesive surface of the label. This adhesive surface can then stick to an internal part of the label printer and interfere with loading the label paper.

SUMMARY OF THE INVENTION

An advantage of a label printer having a label peeling mechanism and a control method for a label printer according to the present invention is that whether the roll paper is loaded into the correct transportation path can be appropriately determined when executing the mechanical initialization process that is run when roll paper is loaded, thus solving the foregoing problems.

A further advantage of a label printer having a label peeling mechanism and a control method for a label printer according to the present invention is that the label paper can be easily loaded and label waste can be reduced.

With a label printing apparatus having a peeling mechanism according to the present invention paper having a plurality of labels continuously affixed to a web liner is loaded inside the label printing apparatus when a main cover is open. A peeling mechanism cover located on the main cover is opened and the paper is then routed through a first or second transportation path according to whether the peeling mechanism is used when. The paper is then conveyed by a paper transportation mechanism when the main cover is closed, and the labels are printed by a print head. This label printing apparatus has a main cover detector for detecting if the main cover is open or closed; a control unit for executing a mechanical initialization process; a switch that is pressed by the operator after the mechanical initialization process runs; and a display unit that starts displaying when the main cover is detected in a closed position and stops displaying when the operator presses the switch.

The main cover detector thus detects when the main cover is closed after the operator opens the main cover and sets paper inside the label printer. The display unit of the label printer then starts to display to inform the operator that the paper must be loaded into the label peeling mechanism. The operator then opens the peeling mechanism cover, sets the paper into the appropriate transportation path according to whether the label peeling mechanism is to be used or not, and then closes the peeling mechanism cover. When the operator then operates the switch, the label printer detects operation of the switch and turns the display off, thus informing the operator that the paper has been set and enabling the control unit to run a mechanical initialization process to, for example, remove play (backlash) in the gears.

The operator can thus reliably set the paper into the paper transportation path matching the printing purpose in this label printer having a label peeling mechanism. The label peeling position has also completed the mechanical initialization process at this time, and can convey the paper using the paper transportation mechanism for printing by the print head.

Furthermore, because the operator must specifically operate the switch, the operator can also confirm that the paper has been correctly loaded and the label printer can reliably position the paper for printing. Problems such as the label printer running the mechanical initialization process and then immediately starting to print even though loading the paper into the label peeling mechanism has not been completed can thus be prevented. An advantage of the present invention is thus that the label printer can dependably execute the mechanical initialization process and the reliability of the label printer can thus be improved.

Preferably, this label printing apparatus having a peeling mechanism also has a label detector for detecting the label position while the paper is conveyed. The control unit transports the paper to a position where an operator can remove the label while the label detector detects the position of the label in the mechanical initialization process.

When the paper is loaded and a label is located away from the print head and cannot be printed, the label paper can be advanced by the paper transportation mechanism while the label detector detects the position of the label so that the operator can then remove the label. The number of labels that are wasted when loading the label paper can thus be minimized, and the labels can be easily removed.

To use the label peeling mechanism, the operator can thus load only the web liner portion of the label paper after removing labels from the web liner into the paper transportation path for using the label peeling mechanism. This is advantageous because only the web liner portion of the label paper should be loaded into the peeling mechanism in order to reduce the load on the paper transportation mechanism.

Further preferably, when the switch is pressed in this label printing apparatus, the control unit transports in reverse and positions the leading edge of a label on the paper relative to the print head using the paper transportation mechanism while the label detector detects the label position, and stops the display before transportation or after transportation.

When the operator closes the peeling mechanism cover to finish setting the label paper and then operates the switch, the next label located at the print head can be reversed and positioned with the leading edge at a printable position. Wasting labels located at a printable position is thus eliminated. The operator can also be informed that the paper is set and ready for printing. When print data is then received, printing can begin immediately from the leading edge of the label.

Yet further preferably, this label printing apparatus also has a peeled label detector for detecting if a label or web liner is in a label discharge opening. When the paper is set in the transportation path for using the peeling mechanism, the control unit transports the paper to a position where an operator can remove the label in the mechanical initialization process. When the peeled label detector detects that the label or the web liner is not in the label discharge opening after the switch is pressed, the control unit transports the label paper in reverse and positions the leading edge of a label on the paper relative to the print head using the paper transportation mechanism while the label detector detects the label position. The display is stopped before or after the label paper is thus conveyed.

If a label is positioned away from the print head where the label cannot be printed when the input unit is operated, this aspect of the invention can advance the label to the label discharge opening for easy removal by the operator. When the operator then loads only the web liner portion of the label paper into the transportation path, closes the peeling mechanism cover to complete loading the paper, and operates the switch, the next label located at the print head can be reversed to a printable location, thereby eliminating label waste. The operator can also be informed that the paper is set and ready for printing. When print data is then received, printing can begin immediately from the leading edge of the label. The label printer thus waits until there is no label or web liner in the label discharge opening and the label paper is correctly loaded.

Yet further preferably, this label printing apparatus also has a communication unit for reporting a standby state to a host computer when the display unit starts to display. When the switch is pressed, the communication unit reports to the host computer that the standby state was cancelled and the display unit is turned off.

The advantage of this aspect of the invention is that the host computer can be informed when the printer is in a standby state waiting for the switch to be pressed and when this standby state is cancelled. The host computer thus knows the timing for presenting a message prompting the operator to set the paper, and the timing for sending the print data to the printer.

Another aspect of the invention is a control method for a label printing apparatus having a peeling mechanism wherein paper having a plurality of labels continuously affixed to a web liner is loaded inside the label printing apparatus when a main cover is open, and when a peeling mechanism cover positioned on the main cover is opened, the paper is conveyed through one or two transportation paths depending on whether or not the peeling mechanism is used, the paper is conveyed by a paper transportation mechanism when the main cover is closed, and the labels are printed by a print head. This control method has steps of: detecting that the main cover is closed; executing a mechanical initialization process and starting a display when the main cover is closed; and stopping the display when a switch is pressed.

The main cover detector thus detects when the main cover is closed after the operator opens the main cover and sets paper inside the label printer. The display unit of the label printer then starts to display to inform the operator that the web must be loaded into the label peeling mechanism. The operator then opens the peeling mechanism cover, sets the paper into an appropriate transportation path according to whether the label peeling mechanism is to be used or not, and then closes the peeling mechanism cover. When the operator then operates the switch, the label printer detects the operation and turns the display off, thus informing the operator that the paper has been set.

Furthermore, because the operator must specifically operate the switch, the operator can also confirm that the paper has been correctly loaded and the label printer can reliably position the paper for printing.

This control method also prevents problems such as the label printer running the mechanical initialization process and then immediately starting to print even though loading the paper to the label peeling mechanism has not been completed. An advantage of the present invention is thus that the label printer can dependably execute the mechanical initialization process and the reliability of the label printer can thus be improved.

Preferably, the mechanical initialization process in this control method preferably also has a step of detecting the label position while conveying the paper to a position where the operator can remove the label.

When the paper is loaded and a label is located away from the print head and cannot be printed, the operator can then remove the label. The number of labels that are wasted when loading the label paper can thus be minimized, and the labels can be easily removed. To use the label peeling mechanism, the operator can thus load only the web liner portion of the label paper after removing labels from the web liner into the paper transportation path for using the label peeling mechanism.

Further preferably, this control method also has a step of transporting the label paper in reverse and positioning the leading edge of a label on the paper relative to the print head while detecting the label position after the switch is pressed.

When the operator closes the peeling mechanism cover to finish setting the label paper and then operates the switch, the next label located at the print head can be reversed and positioned with the leading edge at a printable position. Wasting labels located at a printable position is thus eliminated, and printing can begin immediately from the leading edge of the label when print data is then received.

Further preferably, after a step of detecting the label position while conveying the paper to a position where the operator can remove the label; this control method also has steps of transporting in reverse and positioning the leading edge of a label on the paper relative to the print head while detecting the label position when the label or the web liner is not detected in the label discharge opening after the switch is pressed when the paper is set in a transportation path using the peeling mechanism; and stopping the display before the transportation step or after the transportation step.

If a label is positioned away from the print head where the label cannot be printed when the input unit is operated, this aspect of the invention can advance the label to the label discharge opening for easy removal by the operator. When the operator then loads only the web liner portion of the label paper into the transportation path, closes the peeling mechanism cover to complete loading the paper, and operates the switch, the next label located at the print head can be reversed to a printable location, thereby eliminating label waste. The operator can also be informed that the paper is set and ready for printing. When print data is then received, printing can begin immediately from the leading edge of the label. These operations can also be executed automatically. The label printer thus waits until there is no label or web liner in the label discharge opening and the label paper is correctly loaded.

Yet further preferably, another aspect of this control method also has steps of reporting a standby state to a host computer and starting display by the display unit when the main cover is detected in a closed position; and reporting to the host computer that the standby state was cancelled when the switch is pressed, and stopping display by the display unit.

The advantage of this aspect of the invention is that the host computer can be informed when the printer is in a standby state waiting for the switch to be pressed and when this standby state is cancelled. The host computer thus knows the timing for presenting a message prompting the operator to set the paper, and the timing for sending the print data to the printer.

DESCRIPTION OF THE PREFERRED EMBODIMENTS

A label printer and control method according to a preferred embodiment of the present invention are described below with reference to the accompanying figures.

Figure 1:
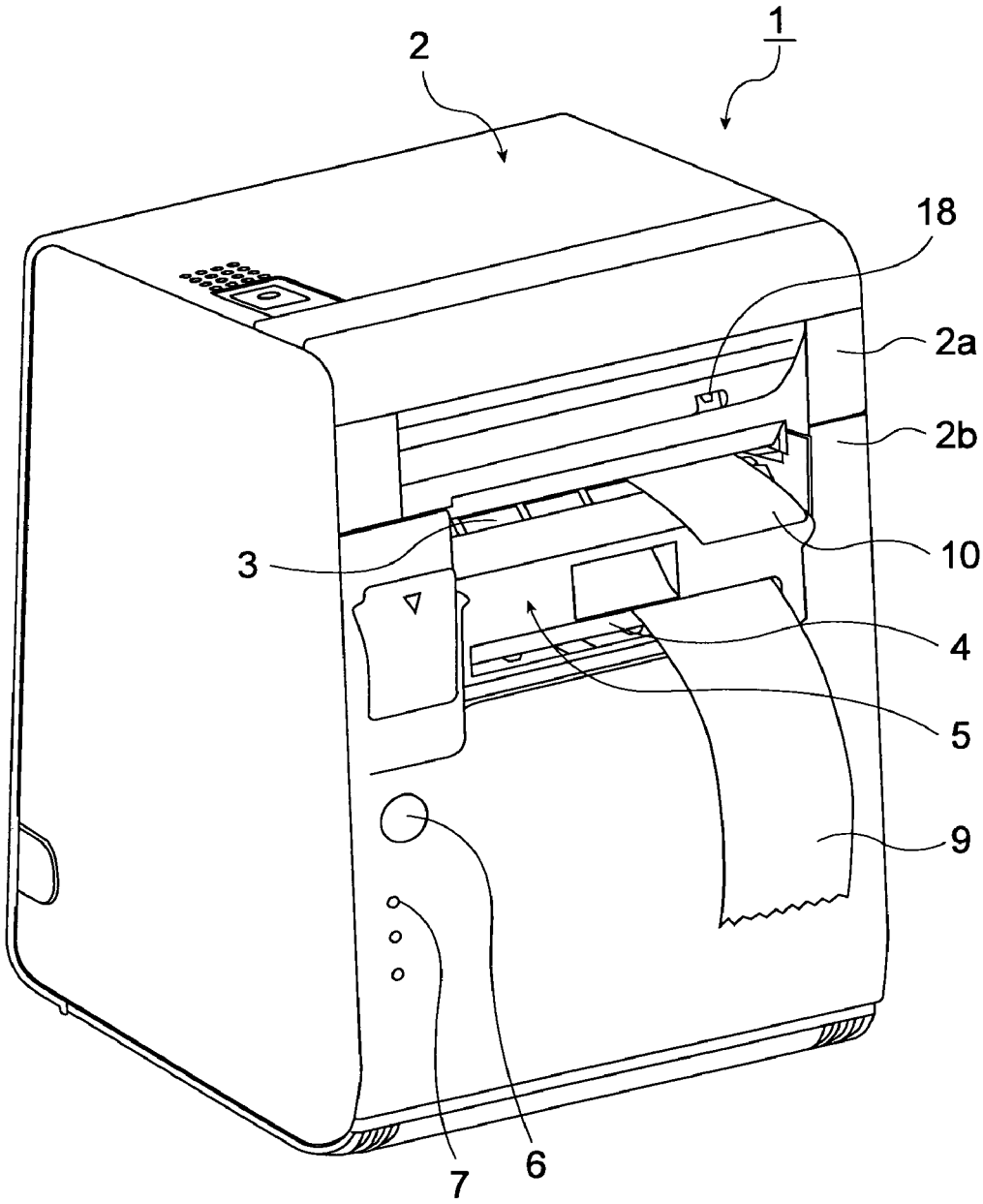
FIG. 1 is an external oblique view of a label printer according to a preferred embodiment of the present invention.
Figure 2:
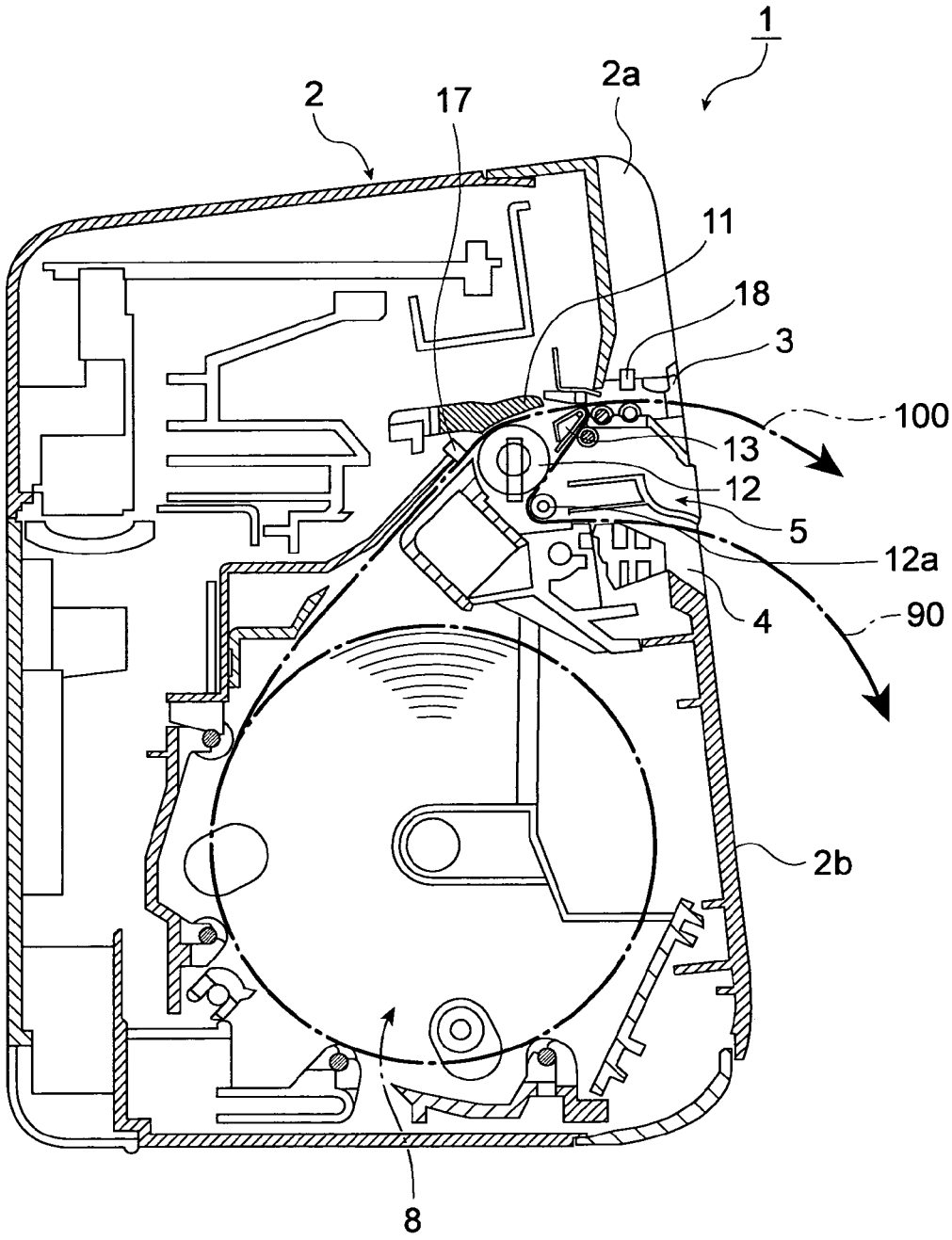
FIG. 2 is a side section view of the label printer shown in FIG. 1.

FIG. 1 is an external oblique view of a label printer according to a preferred embodiment of the present invention, and FIG. 2 is a side section view showing the internal arrangement of this label printer. As shown in FIG. 1, a label printer 1 according to this embodiment of the invention has a printer case 2 with a basically parallelepiped shape. The top portion of the front panel of the printer case 2 is a stationary panel 2*a* fixed to the printer case 2, and the bottom portion is an openable panel 2*b* (main cover) that opens and closes from the printer case 2.

A label discharge slot 3 is formed between the stationary panel 2*a* and openable panel 2*b*. The printed labels 10 are dispensed from this label discharge slot 3 when the label peeling mechanism is used (that is, when in the peeling mode) as illustrated in FIG. 2. The printed label paper 8 (with printed labels still attached) is discharged from this label discharge slot 3 when the peeling mechanism is not used (not illustrated in the figure). The peeling mechanism cover 5 (or peeler cover, see FIG. 4) is attached freely openably and closably below the label discharge slot 3 of the openable panel 2*b*. Peeling mechanism cover 5 is rotatively connected to and positioned on openable panel 2*b* so that it can be opened and closed from panel 2*b*. A web discharge slot 4 for discharging only the web liner 9 when the label peeling mechanism is used is formed at the bottom of the peeling mechanism cover 5. Nothing is discharged from the web discharge slot 4 when the label peeling mechanism is not used. A manual paper feed switch 6 (input unit) is located together with one or more display LEDs 7 (display unit) on the front left side of the openable panel 2*b*. Note that the paper feed switch is shown as a push-button type switch that can be pressed by the operator. However any type of suitable input device could be used, such as toggle switch, a lever or a key on a keyboard.

A roll of label paper 8 is stored inside the printer case 2 as shown in FIG. 2. This label paper 8 has a series of many adhesive labels 10 of a specific length affixed to the front surface of a continuous web liner 9 wound into a roll that is stored inside the printer. Note that the dot-dash line indicated by reference numeral 90 in FIG. 2 denotes the transportation path of the web liner 9 when the peeling mechanism is used, and the imaginary line denoted by reference numeral 100 denotes the transportation path of the labels 10 when the peeling mechanism is used.

When the label paper is loaded into the printer, the leading end of the label paper 8 is pulled out from the printer case 2 and passed between the print head 11 and platen roller 12 to enable transporting the label paper 8 and printing on the labels 10. When the label peeling mechanism is used, the web liner 9 is curved acutely to the back (non-label) side of the web around a web-bending guide 13 of the label peeling mechanism and forming an acutely angled curve at the distal end. The web liner 9 is held and conveyed by the drive platen roller 12 and the driven peeler roller 12*a* (pinch roller) that rotates following the platen roller and constituting the paper transportation mechanism, and is discharged from the web discharge slot 4.

When the label paper 8 passes over the web-bending guide 13 of this label peeling mechanism, the labels 10 adhesively affixed to the front surface of the web liner 9 are unable to follow the transportation path of the web liner 9 and are thus disengaged from the web 9. The peeled labels 10 are then discharged externally from the printer through the label discharge slot 3. The remaining web liner 9 follows a different transportation path than the labels 10, and the labels 10 and web liner 9 are thus separated.

This label printer 1 also has a label detection sensor 17 (label detector) positioned upstream of the print head 11, and a peeled label sensor 18 (peeled label detector) positioned near the label discharge slot 3 at a position slightly above the curved end part of the web-bending guide 13.

The label detection sensor 17 detects the difference between light reflected from the label 10 and light reflected from the web liner 9 to detect the passage of the leading end or trailing end of successive labels, and can thereby determine where the label 10 is positioned. The label detection sensor 17 could alternatively operate by detecting the difference in light passing through the web and label.

The peeled label sensor 18 detects whether light is reflected from a label 10 to detect whether a discharged label 10 is or is not located in front of the peeled label sensor 18. Detection signals from the label detection sensor 17 and peeled label sensor 18 are sent to the CPU 20 of the label printer as described below.

Figure 3:
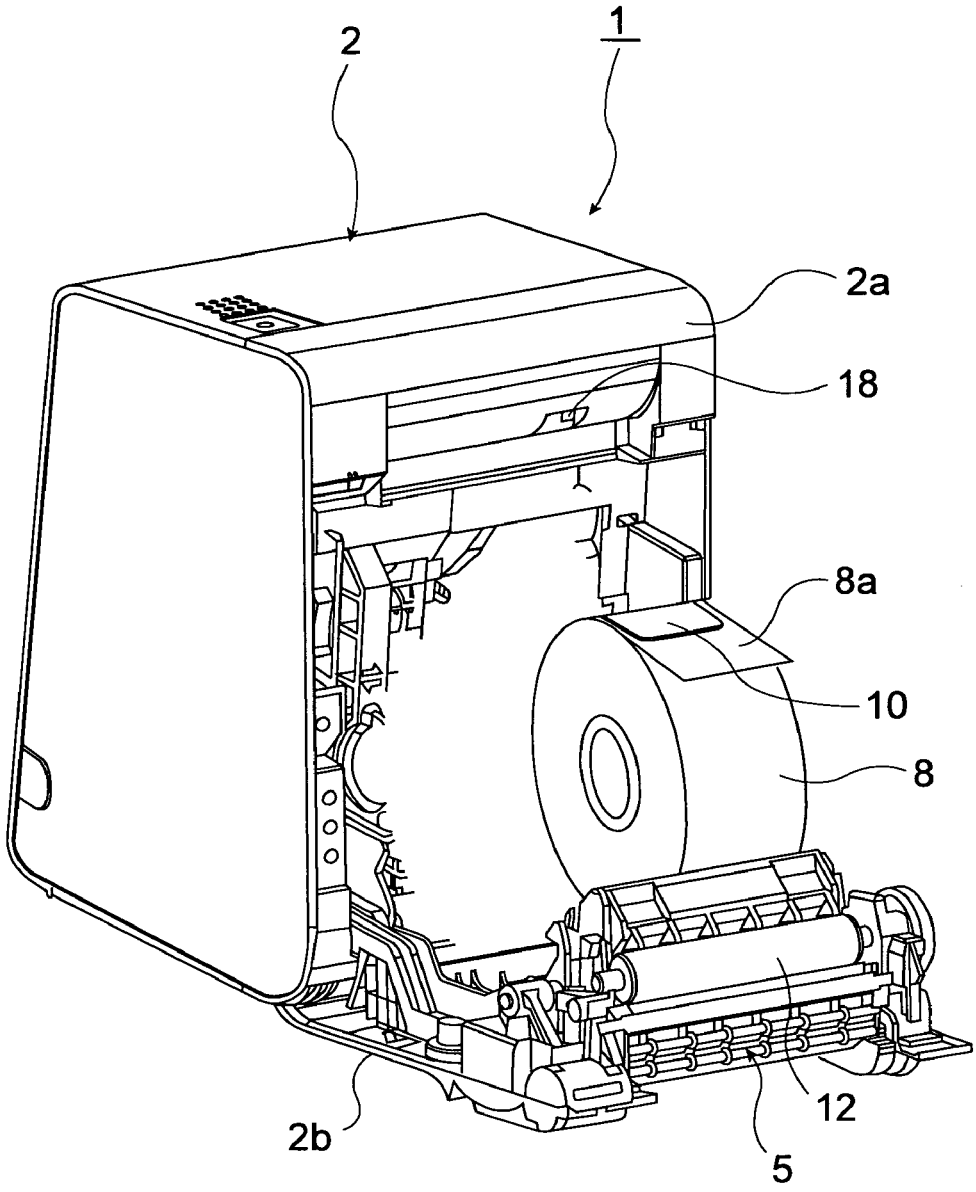
FIG. 3 is an external oblique view showing the label paper replacement method of the label printer shown in FIG. 1.

FIG. 3 is an oblique view showing the openable panel 2*b* of this label printer 1 with a label peeling mechanism when the openable panel 2*b* is pulled forward and opened. This openable panel 2*b* can be pulled forward and opened as shown in FIG. 3 when the end of the label paper 8 is reached and a new roll of label paper 8 must be loaded into the label printer 1, or when the label paper 8 is to be replaced with label paper 8 having a different label length or label width. Thus opening the openable panel 2*b* provides access to the label paper 8 storage compartment, and thus enables loading or replacing the label paper 8.

Figure 4:
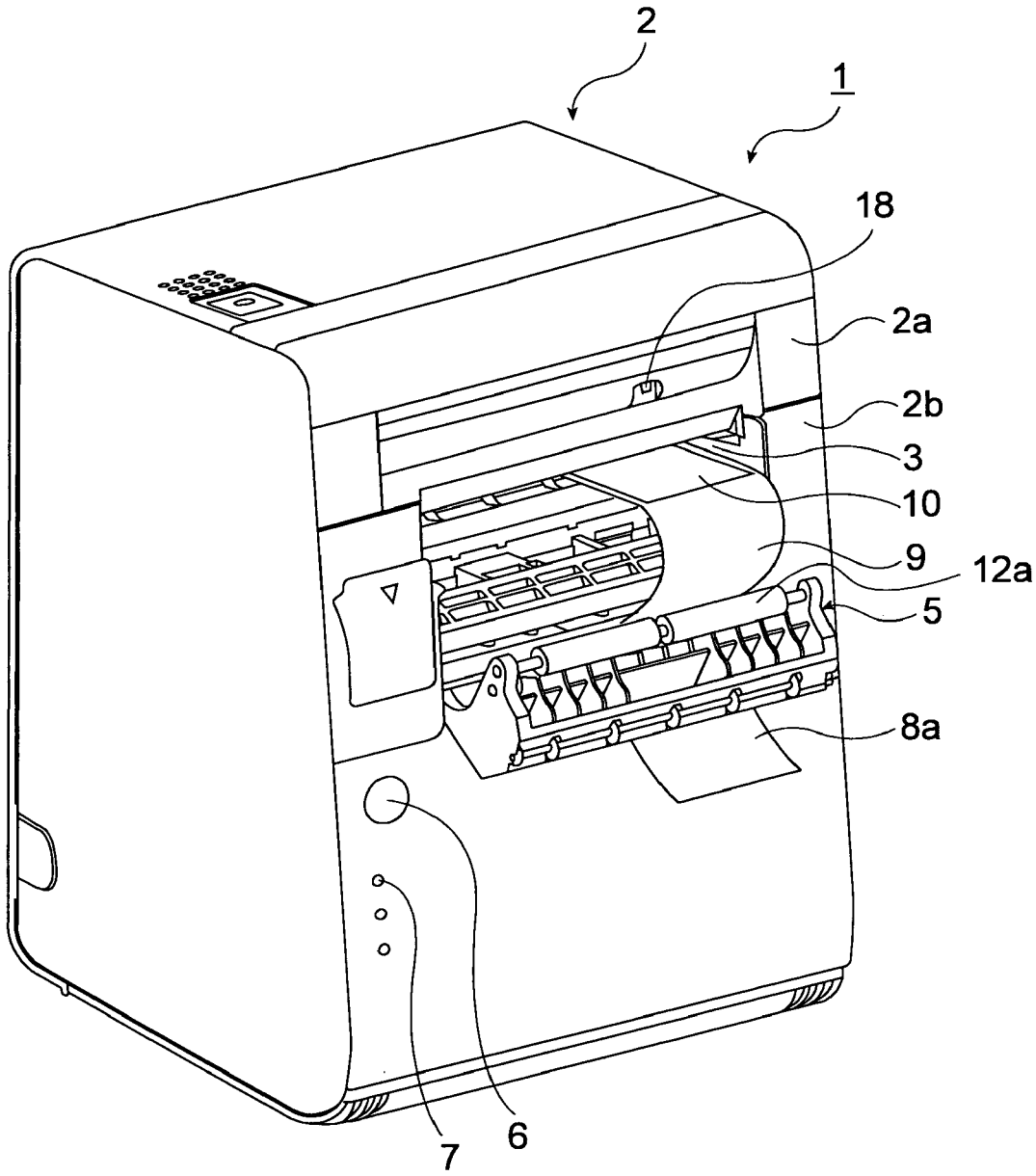
FIG. 4 is an external oblique view showing selection of the paper exit in the label printer shown in FIG. 1.
Figure 5:
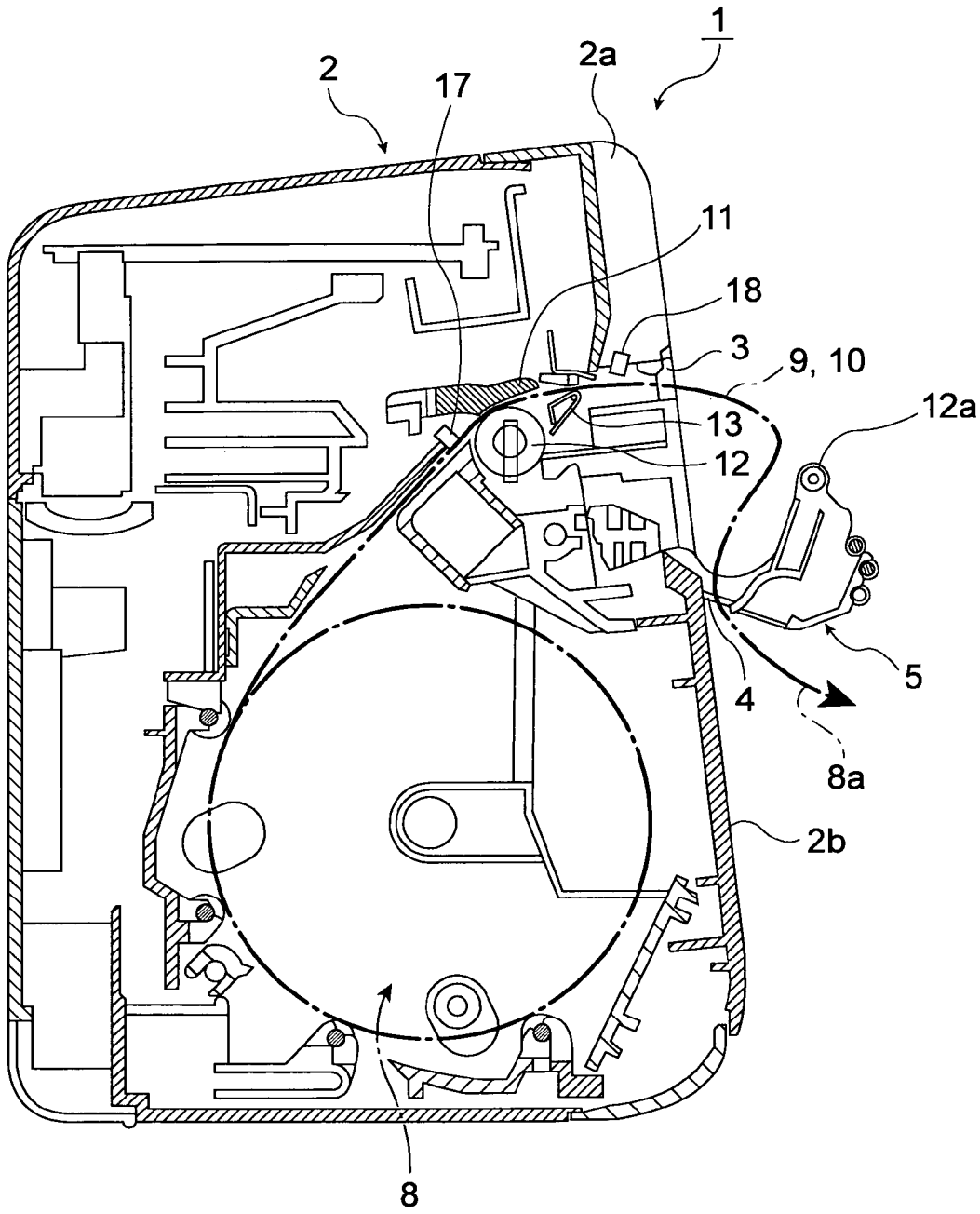
FIG. 5 is a side section view of the label printer shown in FIG. 4.

FIG. 4 and FIG. 5 are an external view and a side section view, respectively, showing how the leading end 8*a* of the label paper 8 is fed outside the printer from the web discharge slot 4 to use the label peeling mechanism.

The peeling mechanism cover 5 positioned between the label discharge slot 3 of the openable panel 2*b* and the web discharge slot 4, and is rotatively connected to open and close freely on the top part of the openable panel 2*b*. After the peeling mechanism cover 5 is opened and the leading end 8*a* of the label paper 8 is passed through the web discharge slot 4 as shown in FIG. 4, closing the peeling mechanism cover 5 sets the label paper 8 for use in the peeling mode using the label peeling mechanism.

The label peeling mechanism functions when the leading end 8*a* of the label paper 8 is pulled outside the case from the web discharge slot 4. As a result, labels 10 printed by the print head 11 are conveyed with the web liner 9 to the web-bending guide 13, and the labels 10 are peeled from the web liner 9 at the curved distal end of the web-bending guide 13 and then discharged from the label discharge slot 3 as shown in FIG. 1 as the label paper 8 is conveyed further downstream with the back of the web liner 9 curving acutely around the distal end of the web-bending guide 13.

If the leading end 8*a* of the label paper 8 is not pulled outside the printer from the web discharge slot 4 and instead is pulled outside the printer from the label discharge slot 3, that is, if the label paper 8 is loaded so that both the labels 10 and web liner 9 are discharged from the label discharge slot 3, multiple consecutive labels 10 can be printed and discharged with the labels 10 intact on the web liner 9 in the non-peeling mode. Multiple labels 10 can thus be batch printed.

When the leading end 8*a* of the label paper 8 is pulled outside the printer through the appropriate transportation path and the openable panel 2*b* is then closed, the label paper 8 is held between the print head 11 and platen roller 12. A main cover switch 16 (detection mechanism, FIG. 6) for detecting opening and closing of the openable panel 2*b* (main cover) is positioned at a suitable location on the printer case 2.

To print labels using the label peeling mechanism, the operator sets the leading end 8*a* of the label paper 8 through the web discharge slot 4 as shown in FIG. 4 and FIG. 5 and then closes the peeling mechanism cover 5. A peeler cover switch 19 (detection mechanism, FIG. 6) is positioned near the peeling mechanism cover 5 to detect opening and closing of the peeling mechanism cover 5, and outputs the detection signal to the CPU 20.

Figure 6:
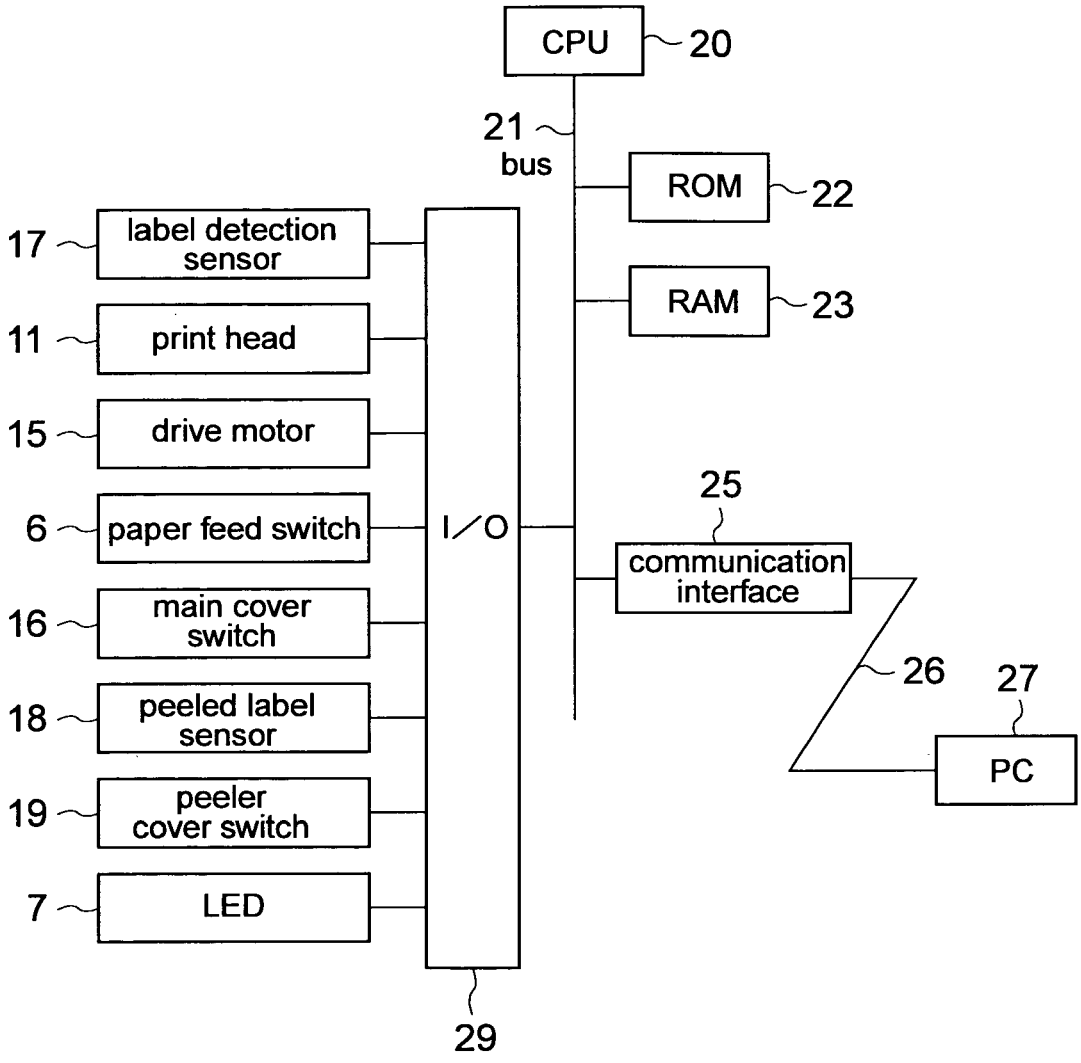
FIG. 6 is a block diagram of the electrical control system of the label printer shown in FIG. 1.

FIG. 6 is a function block diagram of the electrical control system of the label printer 1 shown in FIG. 1. A CPU 20 (control unit) controls label printer 1 operation. Connected to the CPU 20 over a bus 21 are a ROM 22, a RAM 23, I/O 29 and communication interface 25. The ROM 22 stores some programs and data, a printing control program and mechanical initialization program for driving the print head 11 and drive motor 15, a peeling mode setup program, a printing process program, and character data. The RAM 23 functions as temporary storage for storing the label 10 position, received data, and print data generated therefrom, and output data. The peeling mode using the label peeling mechanism and continuous printing (non-peeling) mode can alternatively be set using DIP switches (for example) or the mode setting can be stored in flash ROM (for example) or other nonvolatile memory.

A communication interface 25 is connected to the bus 21, and a personal computer 27 is connected to the communication interface 25 through a cable 26. The personal computer 27 may have a display, and display an instruction to the operator in accordance with received status data from the label printer 1.

An input/output (I/O) unit 29 is connected to the bus 21. Connected through the I/O unit 29 to the bus 21 are the label detection sensor 17, peeled label sensor 18, print head 11, drive motor 15 for platen roller 12, paper feed switch 6, main cover switch 16, peeler cover switch 19, and LED 7. A display such as a liquid crystals display may used alternatively to LED 7. In this case, it is possible to display characters. As will be appreciated various signals and commands flow between CPU 20 the devices connected to I/O 29 via bus 21. For example, CPU 20 controls drive motor 15 with commands and sends print data to print head 11. Also, input signals from the main cover switch 16 indicate if the cover is open or closed, signals from the paper feed switch 6 indicate if the switch has been pressed, signals from the label detection sensor indicate the position of a label 10, etc.

Figure 7:
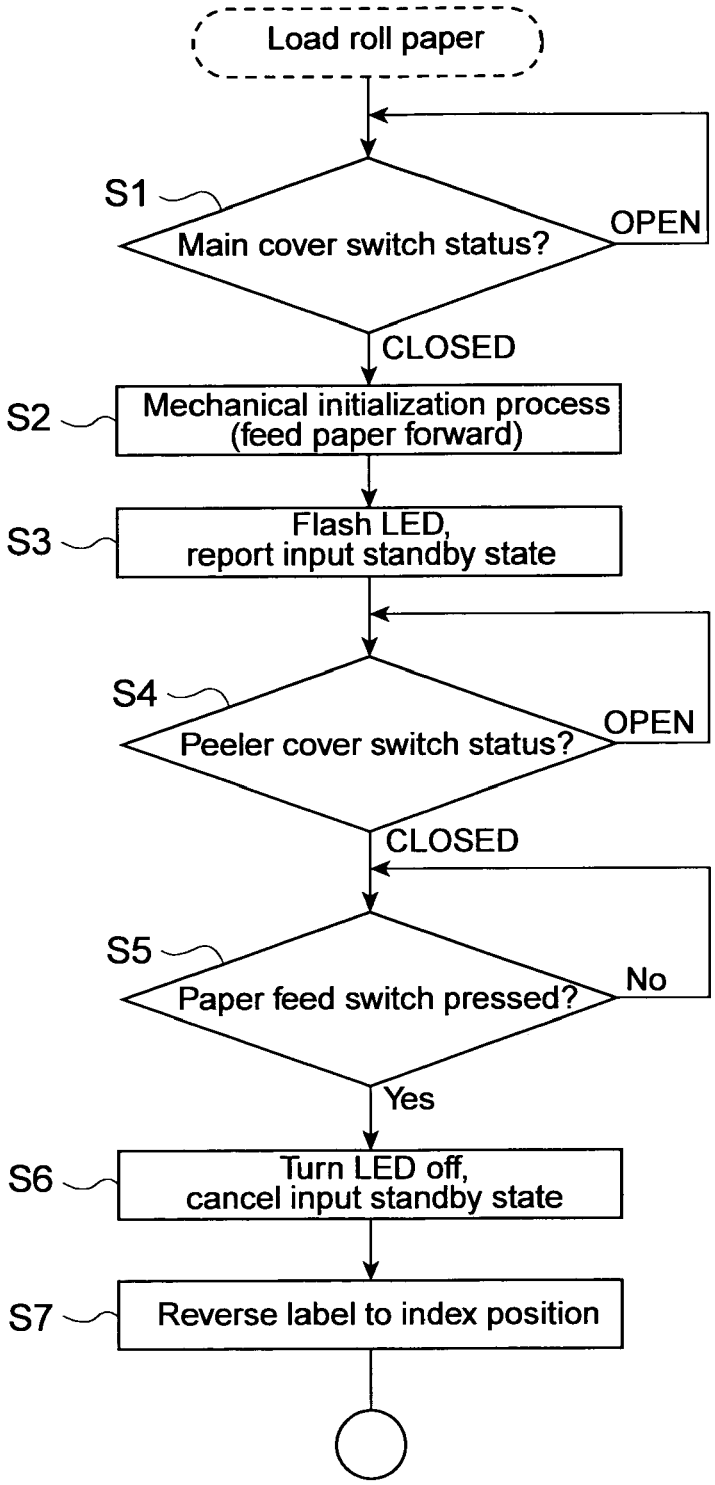
FIG. 7 is a flow chart of the mechanical initialization process run by the CPU shown in FIG. 6.

FIG. 7 is a flow chart of the mechanical initialization process run by the CPU 20 shown in FIG. 6. When the operator replaces the roll paper, for example, the CPU 20 executes this mechanical initialization program from ROM 22.

More specifically, the main cover switch 16 sends an OPEN signal to the CPU 20 when the operator opens the openable panel 2*b* and installs roll paper 8, and the CPU 20 thus starts the mechanical initialization process. Note that a sensor can be positioned where the label paper 8 is stored and control can be based on output from this sensor.

Figure 11A:
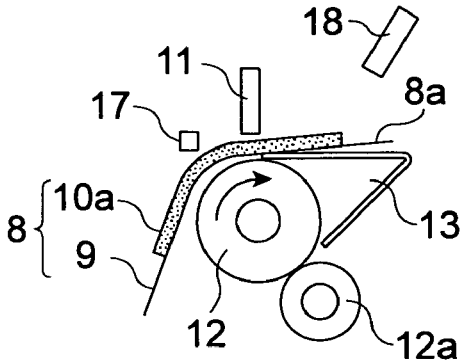
FIGS. 11A to 11D show the label transportation positions as the CPU runs the process shown in FIG. 10.
Figure 11B:
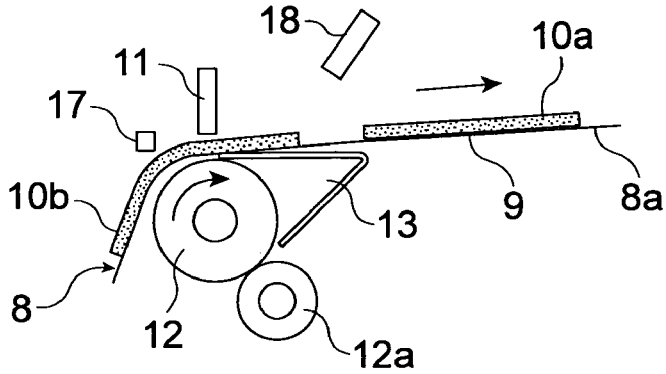
Figure 11C:
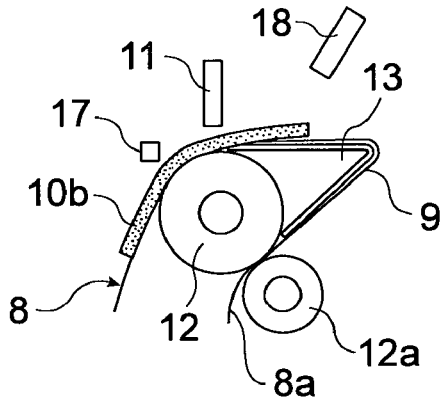
Figure 11C:
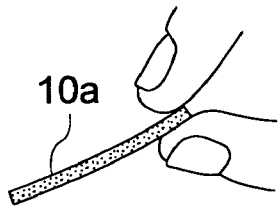

After the label paper 8 is loaded, the mechanical initialization program waits until the main cover switch 16 closes (step S1). When the main cover switch 16 closes, the label paper 8 is conveyed forward a specific distance by the platen roller 12 driven by the drive motor 15 to remove play (backlash) in the gears, for example (step S2). Preferably during step S2 the label paper 8 is advanced while the label detection sensor 17 detects the label 10 position so that the trailing end or leading end of the labels can be determined, a label 10 that is positioned away from the print head 11 where the label cannot be printed can be detected, and the label 10 can be advanced to a position where the label 10 can be removed by the operator (FIG. 11A and FIG. 11B). The smallest number of labels 10 in a non-printable position can thus be removed (FIG. 11C).

In the peeling mode using the label peeling mechanism, the web liner 9 from which unprintable labels 10 have been removed can be routed through the web transportation path 90 in FIG. 2 between the platen roller 12 and peeler roller 12*a*. The LED 7 can also be driven to blink as a way of prompting the operator to set the label paper 8 into the transportation path for the peeling mode using the label peeling mechanism or the continuous printing mode not using the label peeling mechanism, and then press the paper feed switch 6 to indicate when the label paper 8 has been loaded. The personal computer 27 (host) is also informed (via status data) that the printer is waiting for the operator to press the paper feed switch 6 (step S3). The personal computer 27 can also display a message prompting the operator to route the label paper 8 in accordance with a specific mode. Instructions for loading the label paper 8 can also be displayed to help ensure that the operator loads the label paper 8 correctly.

The CPU 20 also determines whether the peeler cover switch 19 is open or closed and waits for an indication that the peeler cover switch 19 is closed (step S4). If the peeler cover switch 19 is open, the operator is loading the label paper 8 and the peeling mechanism cover 5 is not closed, and the CPU 20 therefore waits to proceed to step S5. This prevents the label indexing operation (step S7) and subsequent printing process from running if the paper feed switch 6 is accidentally pressed while the peeling mechanism cover 5 is open, or if the peeling mechanism cover 5 is closed to finish loading the paper but the operator then realizes that the paper is not correctly loaded (not execute step S5).

After the CPU 20 determines that the peeler cover switch 19 is closed, the CPU 20 waits for the operator to press the paper feed switch 6 (step S5).

The operator presses the paper feed switch 6 after confirming the mode indicated by the LED 7, setting the label paper 8 appropriately to the mode, closing the peeling mechanism cover 5, and confirming that the label paper 8 is set to the desired mode.

The CPU 20 turns the LED 7 off after detecting that the paper feed switch 6 was pressed and reports to the personal computer 27 (via status data) that the standby state waiting for the paper feed switch 6 to be pressed has been cancelled (step S6). The personal computer 27 thus knows that the label paper 8 is set for the specified mode, and knows the timing for preparing and sending print data to the label printer 1.

Figure 11D:
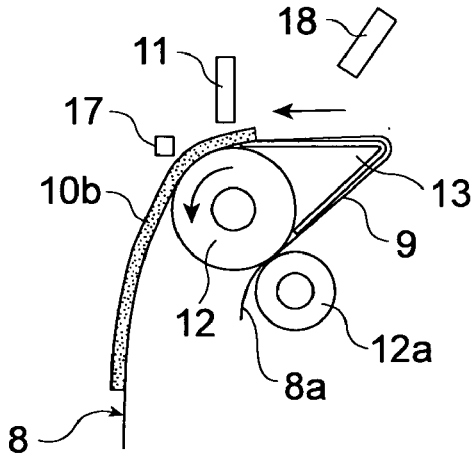
Figure 12A:
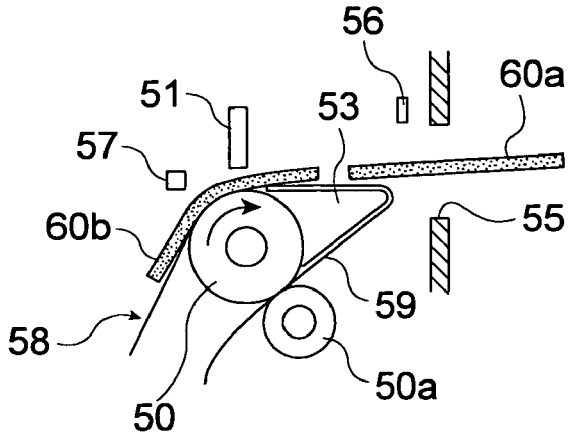
FIGS. 12A to 12C show a label peeling mechanism according to the prior art.
Figure 12B:
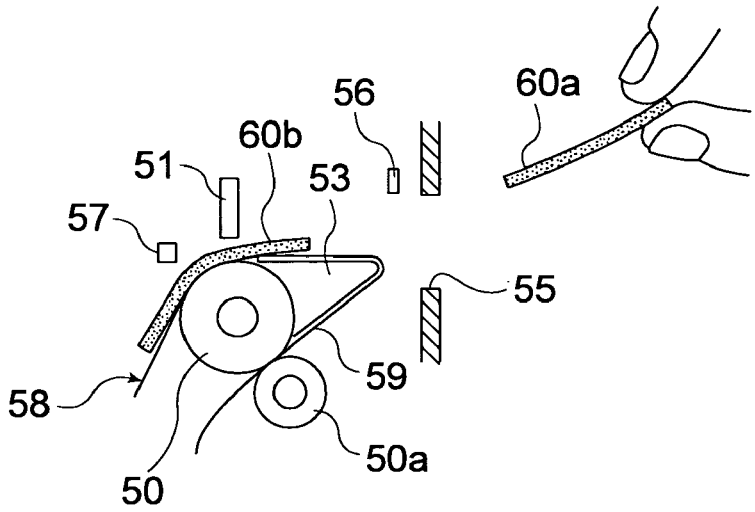
Figure 12C:
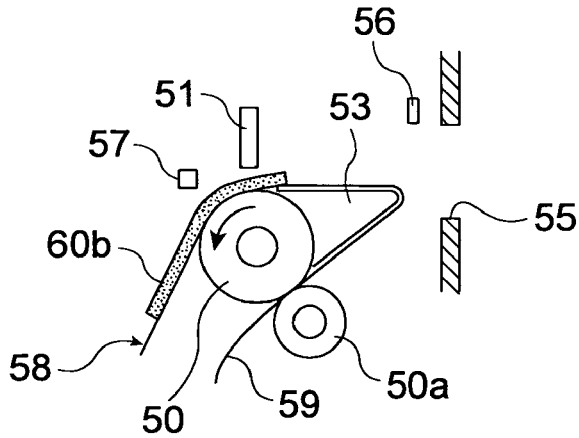
FIG.12C PRIOR ART

The label paper 8 is then reversed while the label detection sensor 17 detects the position of the label 10, and the next label located at the print head can thus be reversed and the leading end of the label can be returned to the printable position (label indexing process) (step S7) (FIG. 11D). After step S7 the CPU 20 reads the printing control program and prints labels 10 based on the print data received from the personal computer 27.

Note that the sequence of steps S6 and S7 can be reversed.

The label indexing process is described more specifically below.

The peeled label sensor 18 in this embodiment of the invention is located downstream in the label transportation direction from the print head 11. Therefore, when the peeled label sensor 18 detects the leading end of a label, a specific number of reverse (or forward) rotation drive pulses are supplied to the drive motor (a stepping motor) of the platen roller 12 to position the leading edge of the label relative to the print head 11 (FIG. 11D).

If the paper is advanced forward in step S2 and stops when the label detection sensor 17 detects the leading edge of the label, the mechanical initialization is controlled by supplying a specific number of forward rotation drive pulses to the drive motor 15 in step S7 because the label detection sensor 17 is located upstream from the print head 11 in the transportation direction.

As described above the label indexing process does not run until the paper feed switch 6 is operated. The printer is therefore prevented from running the initialization process and starting to print even though loading the label paper 8 is not completed.

Furthermore, by displaying an indication prompting the user to set the label paper 8, the operator can also easily know that the label printer 1 is not ready to print, press the paper feed switch 6 after setting the label paper 8, and thus control operation after confirming that the paper is correctly loaded.

This embodiment of the invention also has a peeler cover switch 19 as described above, and the CPU 20 detects the open or closed status of the peeler cover switch 19 in step S4 in FIG. 7. However, because process execution can also be controlled based on whether or not the paper feed switch 6 is pressed, the peeler cover switch 19 and step S4 are not always necessary and can be omitted. An aspect of the invention in which these are omitted is shown in FIG. 8 and FIG. 9.

Figure 8:
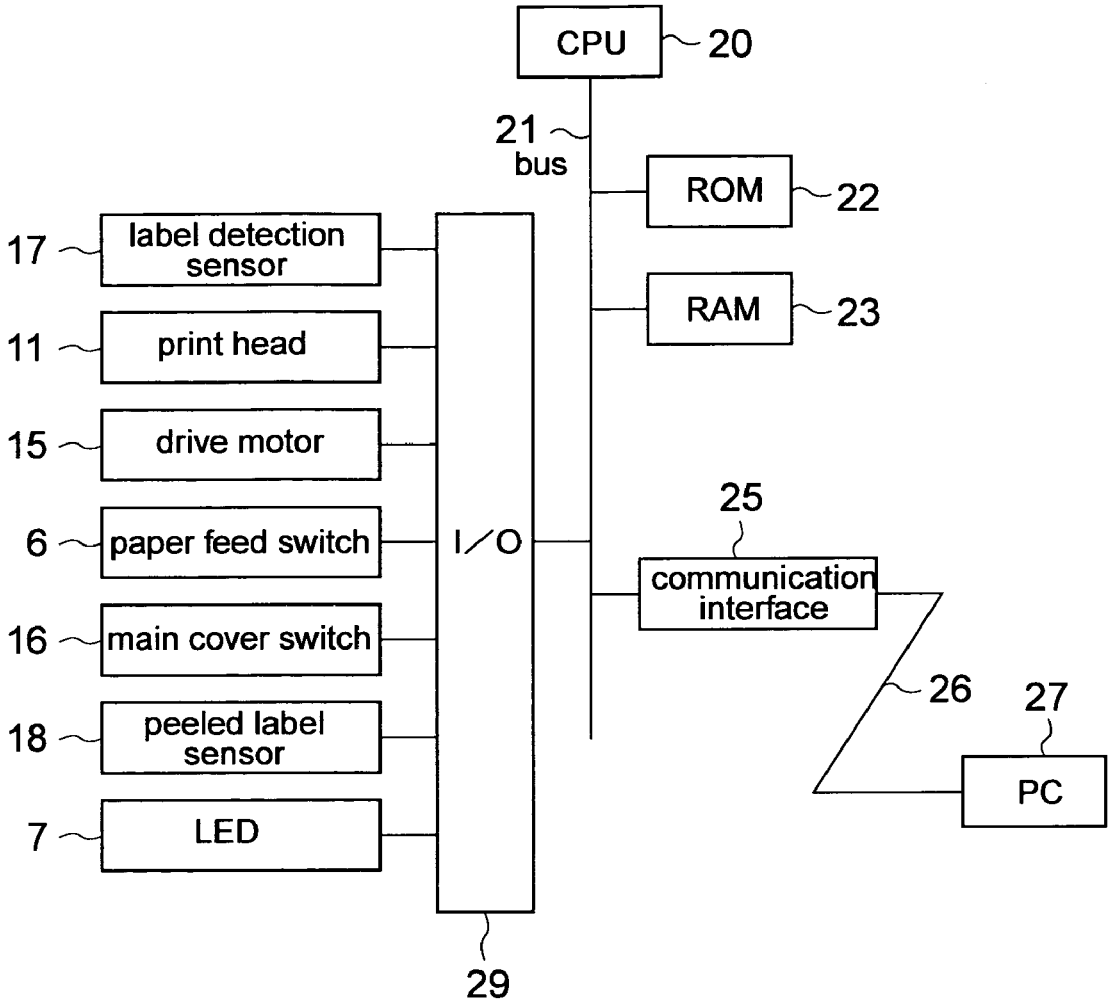
FIG. 8 is a block diagram of the electrical system of a label printer according to another embodiment of the invention.

FIG. 8 is a function block diagram showing the electrical control system of a label printer according to another embodiment of the present invention. Connected over a bus 21 to the CPU 20 that controls the label printer are ROM 22 for storing certain programs and data, including the printing control program and mechanical initialization program, and RAM 23 that functions as temporary memory. A communication interface 25 is connected to the bus 21, and a personal computer 27 used as the host computer of the label printer 1 is connected through a cable 26 connected to the communication interface 25. An I/O unit 29 is also connected to the bus 21. Connected through the I/O unit 29 are label detection sensor 17, print head 11, drive motor 15 for the platen roller 12, paper feed switch 6, main cover switch 16, peeled label sensor 18, and LED 7. Note that a peeler cover switch 19 is not provided.

Figure 9:
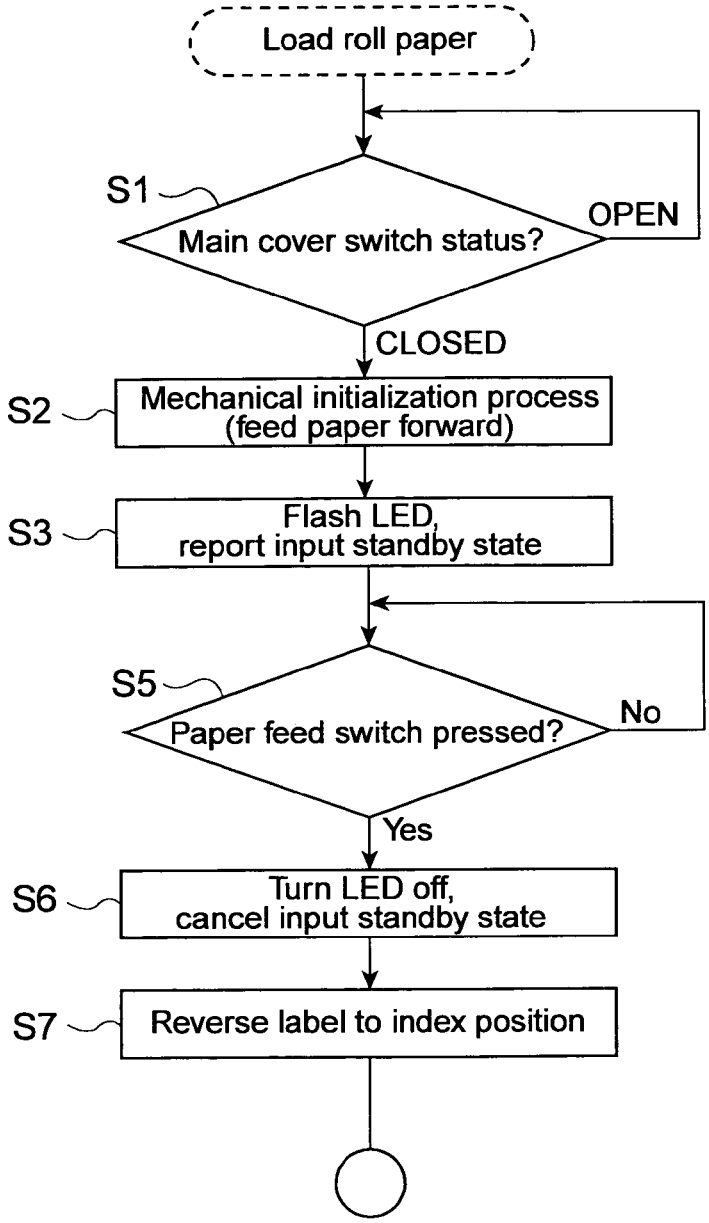
FIG. 9 is a flow chart of the label paper loading process run by the CPU shown in FIG. 8.

FIG. 9 is a flow chart showing the mechanical initialization program run by the CPU 20 shown in FIG. 8. Steps S1, S2, S3, S5, S6, and S7 are identical to the steps of the same numbers in the flow chart shown in FIG. 7, while step S4 shown in FIG. 7 is omitted. As described above, the order of steps S6 and S7 can be reversed.

This embodiment of the invention enables omitting the peeler cover switch 19, and thus has the additional advantage of being able to lower the manufacturing cost of the printer.

Figure 10:
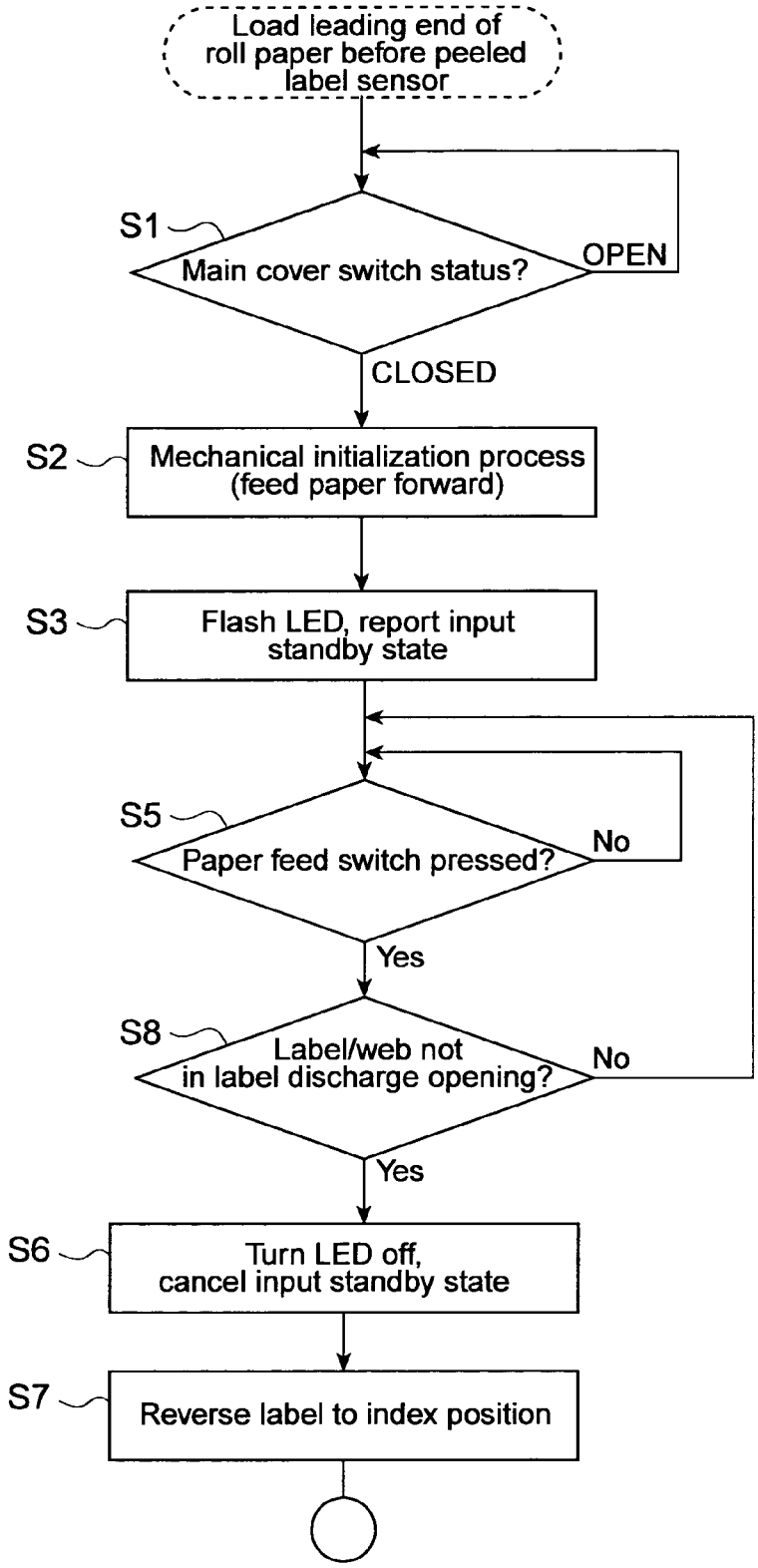
FIG. 10 is a flow chart of the program run by the CPU shown in FIG. 6 to use the peeling mode.

FIG. 10 is a flow chart showing the peeling mode setup program using the peeled label sensor 18. The operator opens the openable panel 2*b* (main cover) of the label printer 1 as shown in FIG. 3, places a new roll of label paper 8 inside the label printer 1, and sets the leading end 8*a* of the label paper 8 in front of the peeled label sensor 18. When the openable panel 2*b* is then closed to hold the paper between the print head 11 and platen roller 12, the CPU 20 reads the peeling mode setup program from ROM and runs the program.

The CPU 20 first detects the status of the main cover switch 16 and waits for the openable panel 2*b* (main cover) to be closed (step S1). When the openable panel 2*b* is closed, step S1 returns YES and control goes to step S2.

The CPU 20 then outputs a forward feed command to the drive motor 15 in step S2, and the position of the first label 10*a* on the web liner 9 thus advances as shown in FIG. 11A. Web transportation stops when the first label 10*a* affixed to the web liner 9 reaches a position where the label can be removed as shown in FIG. 11B, and control goes to step S3.

Whether the first label 10*a* has reached a peelable position can be calculated by the CPU 20 based on the distance of platen roller 12 rotation and whether the label detection sensor 17 detects the leading edge or trailing edge of the first label 10*a* or the leading edge or trailing edge of the next label 10*b*. This calculation could alternatively be based on the distance of platen roller 12 rotation after the peeled label sensor 18 detects the leading edge of the first label 10*a*.

The operator is then prompted by flashing the LED 7, for example, and the personal computer 27 (host computer) is informed (via the status data) that the CPU 20 is waiting for the paper feed switch 6 to be pressed (step S3). With the peeling mechanism cover 5 open as shown in FIG. 4 and FIG. 5, the operator then peels the first label 10*a* positioned as shown in FIG. 11B from the web liner 9, passes the now-bare leading end of the web liner 9 around the web-bending guide 13 of the label peeling mechanism from the back side of the web and out through the web discharge slot 4 (the web transportation path 90 in FIG. 2 between the platen roller 12 and peeler roller 12*a*), closes the peeling mechanism cover 5, and presses the paper feed switch 6.

The peeled label sensor 18 then determines if a label is present in the label dispenser slot (step S8). If the peeled label sensor 18 determines that the first label 10*a* or web liner 9 is not present in the label dispenser slot, the label paper 8 is loaded as shown in FIG. 11C. When the CPU 20 then detects that the paper feed switch 6 was pressed (step S5), the CPU 20 turns the LED 7 off and reports to the personal computer 27 that the standby state waiting for the paper feed switch 6 to be pressed has been cancelled (step S6).

The label paper 8 is then reversed while the label detection sensor 17 detects the position of the label 10, and the next label located at the print head can thus be reversed and the leading end of the label can be returned to the printable position (label indexing process) (step S7). If the peeled label sensor 18 detects the first label 10*a* or web liner 9 at this time (step S8 returns no), operation waits until the first label 10*a* or web liner 9 is removed from the label dispenser slot even if the paper feed switch 6 is pressed. Operation advances to the next step only when the paper feed switch 6 is pressed after the first label 10*a* and web liner 9 are removed and step S8 returns yes. This sequence ensures that the label paper 8 is correctly loaded.

Note that the sequence of steps S6 and S7 can be reversed.

The CPU 20 waits for the paper feed switch 6 to be pressed in step S5. When the CPU 20 detects that the paper feed switch 6 was pressed, the CPU 20 outputs a reverse feed command to the drive motor 15 of the platen roller 12 to position the leading edge of the next label 10*b* relative to the print head 11, and thus controls transporting the next label 10*b* to the label indexing position as shown in FIG. 11D. The distance from the label peeling position to the label indexing position is determined by the length of the label, and the label position can be easily calculated and controlled based on the label length, the gap between labels, and how far the platen roller 12 turns. The printing process is then controlled according to the printing control program, by the CPU 20.

The number of labels 10 that must be peeled before printing starts can thus be limited to the one label, that is, the first label 10*a*, and label 10 waste can thus be reduced when opening the openable panel 2*b* of the label printer 1 and loading the label paper 8 with this embodiment of the invention. Loading the label paper is therefore easier because peeling a label 10 before setting the label paper is not necessary, and is also more efficient because the adhesive side of the label is not exposed when loading the paper.

It will be evident to one with ordinary skill in the related art that the main cover, peeling mechanism cover, detection mechanism, and control mechanism of a label printer having a label peeling mechanism according to the present invention shall not be limited to the arrangements described in the foregoing embodiments and can be varied in many ways without departing from the scope of the accompanying claims.

For example, the print head 11 of a label printer according to the present invention is commonly a thermal print head or an inkjet print head, but the invention shall not be so limited and can be applied to a label printer having a different type of print head.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A label printing apparatus comprising:

a main cover;

a peeling mechanism;

a peeling mechanism cover positioned on and openable from the main cover;

a first transportation path that is utilized when the peeling mechanism is used;

a second transportation path that is utilized when the peeling mechanism is not used;

a transportation mechanism that conveys paper having a plurality of labels affixed to a web liner through one of the first or second transportation paths;

a print head that prints on the labels;

a main cover detector that detects if the main cover is open or closed;

a control unit that executes a mechanical initialization process;

wherein the paper is loaded inside the label printing apparatus when the main cover is open, and when the peeling mechanism cover is open the paper is routed through one of the first or second transportation paths depending on whether or not the peeling mechanism is used;

a switch that is pressed;

a communication unit that reports an input standby state to a host computer, and when the switch is pressed, reports to the host computer that the input standby state is cancelled; and a display unit that starts displaying responsive to detecting a closed position of the main cover and stops displaying when the switch is pressed.

2. A label printing apparatus as in claim 1, further comprising a label detector that detects a label position while the paper is conveyed;

wherein, while the label detector detects the position of the label in the mechanical initialization process, the control unit controls the paper transportation mechanism to convey the paper to a position where an operator can remove the label.

3. A label printing apparatus as in claim 2, wherein, while the label detector detects the label position, the control unit controls the paper transportation mechanism to convey the paper in reverse to position the leading edge of a label on the paper relative to the print head.

4. A label printing apparatus as in claim 2, further comprising a peeled label detector that detects if a label or web liner is in a label discharge opening;

wherein, when the paper is conveyed through the first transportation path and the switch is pressed, the control unit controls the paper transportation mechanism to convey the paper in reverse to position the leading edge of a label on the paper relative to the print head when the peeled label detector detects that the label or the web liner is not in the label discharge opening.

5. A control method for a label printing apparatus having a peeling mechanism; a first transportation path that is utilized when the peeling mechanism is used; a second transportation path that is utilized when the peeling mechanism is not used;

a transportation mechanism that conveys paper having a plurality of labels affixed to a web liner through one of the first or second transportation paths; a print head that prints on the labels; and wherein the paper is loaded inside the label printing apparatus when the main cover is open, and when the peeling mechanism cover is open the paper is routed through one of the first or second transportation paths depending on whether or not the peeling mechanism is used; the control method comprising:

detecting that the main cover is closed, and responsive to detecting that the main cover is dosed, reporting an input standby state to a host computer;

executing a mechanical initialization process and starting a display responsive to detecting that the main cover is closed;

pressing a switch, and responsive to pressing the switch, reporting to the host computer that the input standby state was cancelled; and stopping the display when the switch is pressed.

6. A control method for a label printing apparatus as in claim 5, wherein the mechanical initialization process comprises detecting a label position while conveying the paper to a position where an operator can remove the label.

7. A control method for a label printing apparatus as in claim 6, further comprising:

transporting the paper in reverse and positioning the leading edge of a label on the paper relative to the print head after the switch is pressed.

8. A control method for a label printing apparatus as in claim 6, further comprising:

detecting if a label or web liner is in label discharge opening; and when the paper is conveyed through the first transportation path, transporting the paper in reverse and positioning the leading edge of a label on the paper relative to the print head when the label or the web liner is not detected in a label discharge opening after the switch is pressed.

* * * * *

UNITED STATES PATENT AND TRADEMARK OFFICE

CERTIFICATE OF CORRECTION

PATENT NO. : 7,674,055 B2
APPLICATION NO. : 11/181283
DATED : March 9, 2010
INVENTOR(S) : Go Hiroike et al.

It is certified that error appears in the above-identified patent and that said Letters Patent is hereby corrected as shown below:

Title page,
Item (56) References Cited
Foreign Patent Documents, please insert,

| | |
|---|---|
| **--JP 11171155** | **6/1999--** |
| **--JP 2002019218** | **1/2002--** |
| **--JP 2001232875** | **8/2001--** |
| **--JP 2004115041** | **4/2004--** |
| **--JP 1-277821** | **10/1999--** |
| **--JP 11-314624** | **11/1999--** |
| **--JP 10-166629** | **6/1998--** |
| **--JP 10-193651** | **7/1998--** |

Signed and Sealed this

Twenty-ninth Day of June, 2010

David J. Kappos

David J. Kappos
*Director of the United States Patent and Trademark Office*